US009241547B2

(12) United States Patent
Raymond

(10) Patent No.: US 9,241,547 B2
(45) Date of Patent: Jan. 26, 2016

(54) CLOSURE ASSEMBLY INCORPORATING AN EASY ACCESS TAB INTEGRATED INTO HOOK AND LOOP FASTENER ELEMENTS AND METHOD FOR FORMING THE SAME

(71) Applicant: Central Lake Armor Express, Inc., Central Lake, MI (US)

(72) Inventor: Charles C. Raymond, Mancelona, MI (US)

(73) Assignee: Central Lake Armor Express, Inc., Central Lake, MI (US)

( * ) Notice: Subject to any disclaimer, the term of this patent is extended or adjusted under 35 U.S.C. 154(b) by 0 days.

(21) Appl. No.: 13/644,397

(22) Filed: Oct. 4, 2012

(65) Prior Publication Data

US 2013/0086775 A1 Apr. 11, 2013

Related U.S. Application Data

(60) Provisional application No. 61/545,353, filed on Oct. 10, 2011.

(51) Int. Cl.

| | |
|---|---|
| ***A44B 18/00*** | (2006.01) |
| ***A41F 1/00*** | (2006.01) |
| ***A41D 1/06*** | (2006.01) |
| ***A41D 13/00*** | (2006.01) |

(52) U.S. Cl.

CPC . *A44B 18/00* (2013.01); *A41D 1/06* (2013.01); *A41D 13/0012* (2013.01); *A41F 1/00* (2013.01); *Y10T 24/27* (2015.01); *Y10T 24/2758* (2015.01)

(58) Field of Classification Search

CPC ..... A61F 13/62; A61F 13/5622; A61F 1/00; A41D 13/1209; A41D 2200/10; A41D 2400/44; Y10T 24/27; Y10T 24/33; Y10S 24/11

USPC ..... 24/448, 452; 2/912, 913

See application file for complete search history.

(56) References Cited

U.S. PATENT DOCUMENTS

| | | | | | |
|---|---|---|---|---|---|
| 3,843,971 | A | * | 10/1974 | Delanty et al. | 2/114 |
| 4,075,716 | A | * | 2/1978 | Collins | 2/114 |
| 4,290,148 | A | * | 9/1981 | Roberts | 2/51 |
| 4,476,639 | A | | 10/1984 | Zaccaria | |
| 4,547,982 | A | * | 10/1985 | Gamm | 36/114 |
| 4,601,066 | A | * | 7/1986 | Campbell | 2/70 |
| 4,656,670 | A | * | 4/1987 | Schluter | 2/92 |
| 5,176,670 | A | * | 1/1993 | Roessler et al. | 604/391 |
| 5,401,275 | A | * | 3/1995 | Flug et al. | 604/391 |
| 5,504,944 | A | * | 4/1996 | Bromer et al. | 2/269 |
| 5,537,722 | A | * | 7/1996 | Niederhofer et al. | 24/304 |

(Continued)

*Primary Examiner* — Victor Batson
*Assistant Examiner* — David Upchurch
(74) *Attorney, Agent, or Firm* — Marshall, Gerstein & Borun LLP

(57) ABSTRACT

An easy access tab integrated into a hook closure forming a portion of overlapping hook and loop engaging surfaces of an adjustable garment. An edge extending tab is reverse folded over and against a forward and central most subset area of the hook surface and is subsequently sonically heat bonded to create a crushed or otherwise smoothed subset surface area maintaining a low profile and without any significant weight addition. The crushed area enables a user to insert one or more digits between the opposing hook and loop configured surfaces of the closure elements to facilitate easier opening and without damaging the closure elements. A corresponding method is also disclosed for sonically heat bonding the reverse, folded tab applied against the hook surface utilizing the above structure.

8 Claims, 3 Drawing Sheets

(56) References Cited

U.S. PATENT DOCUMENTS

| | | | | | |
|---|---|---|---|---|---|
| 5,554,146 | A | * | 9/1996 | Niederhofer et al. | 604/391 |
| 5,624,429 | A | * | 4/1997 | Long et al. | 604/391 |
| 5,688,137 | A | * | 11/1997 | Bustance | 434/247 |
| 5,692,240 | A | * | 12/1997 | Steele | 2/129 |
| 5,722,127 | A | * | 3/1998 | Coates | 24/304 |
| 5,901,376 | A | * | 5/1999 | Deirmendjian et al. | 2/114 |
| 5,926,926 | A | * | 7/1999 | Kato | 24/442 |
| 6,099,516 | A | * | 8/2000 | Pozniak et al. | 604/386 |
| 6,138,278 | A | * | 10/2000 | Taylor et al. | 2/114 |
| 6,374,414 | B1 | | 4/2002 | Collier | |
| 6,419,667 | B1 | * | 7/2002 | Avalon et al. | 604/391 |
| 6,508,797 | B1 | * | 1/2003 | Pozniak et al. | 604/385.11 |
| 6,564,386 | B2 | * | 5/2003 | Fujikawa et al. | 2/51 |
| 6,986,164 | B1 | | 1/2006 | Morales | |
| 7,168,103 | B2 | * | 1/2007 | Aldridge et al. | 2/458 |
| 8,127,370 | B2 | * | 3/2012 | Nunn | 2/69 |
| 8,403,719 | B2 | * | 3/2013 | Drennan et al. | 441/65 |
| 2002/0156406 | A1 | * | 10/2002 | Moore et al. | 602/4 |
| 2010/0132091 | A1 | * | 6/2010 | Young et al. | 2/102 |
| 2011/0086561 | A1 | * | 4/2011 | Drennan et al. | 441/65 |
| 2011/0231976 | A1 | * | 9/2011 | Herbener et al. | 2/2.5 |

* cited by examiner

CLOSURE ASSEMBLY INCORPORATING AN EASY ACCESS TAB INTEGRATED INTO HOOK AND LOOP FASTENER ELEMENTS AND METHOD FOR FORMING THE SAME

CROSS-REFERENCE TO RELATED APPLICATIONS

The present application claims the priority of U.S. Ser. No. 61/545,353 filed Oct. 10, 2011.

FIELD OF THE INVENTION

The present invention discloses an easy access tab which is integrally defined into selected hook and loop fastener closure elements, such as which are inter-engaged in overlapping fashion in one example associated with an adjustable vest-like garment. The access tab exhibits a crushed subset surface area typically produced by an initial edge extending portion of the tab which is folded over against a forward and central most subset area of the hook surface and subsequently sonically heat bonded to itself as a single layer maintaining a low profile and without any significant weight addition. The crushed area formed within the entryway location of the hook surface enables a user to insert one or more digits (fingers or thumb) between the opposing hook and loop configured surfaces of the opposing closure elements to facilitate easier opening and without damaging the closure elements.

BACKGROUND OF THE INVENTION

Hook and loop attachment straps are known in the art for use in assisting in opening hook and loop configured closure elements. A problem with such conventional straps, which are typically secured in extending fashion from an edge proximate location of a given one of the closure elements, is that they typically lack any entryway or starting point for initiating controlled and effective "tear away" separation between the closures, this often resulting in damage in the instance of excessive pulling forces being exerted at locations of the closure elements which are not designed to withstand such heavy forces.

Additional attempts have included separating the fabric and webbing tabs to cover the hook teeth in order to create an easier control point, such requiring either thread stitching or glue with the undesirable result being a buildup of material layers with attendant undesirable extra weight.

Other known examples of prior art designs including the tactical shirt for carrying a concealed weapon which is depicted in U.S. Pat. No. 6,986,164 to Morales and which includes a hidden front pocket exhibiting an article supporting cavity accessible from a vertical opening line. A pair of hook and loop patches are provided between the overlaying panel and the shirt, with an opening between the two providing for access to the interior cavity. Disadvantages associated with the Morales construction include its limitation to being used with a cavity enclosure application as well as the use of multiple hook and loop portions (two hook and two loop).

Other secondary references of note include each of the adjustment system for length of a section of a garment (U.S. Pat. No. 6,374,414 to Collier), the no lace shoe with adjustable strap fastening system (U.S. Pat. No. 4,476,639 to Zaccaria) and the surgical gown with pull tab closure (U.S. Pat. No. 4,290,148 to Roberts).

SUMMARY OF THE INVENTION

As previously described, the present invention discloses an easy access tab integrated into a hook closure forming a portion of overlapping hook and loop engaging surfaces such as are associated with an adjustable vest-like garment or the like. The access tab exhibits a crushed or otherwise smoothed subset surface area typically produced by an initial edge extending portion of the tab which is folded over against a forward and central most subset area of the hook surface and is subsequently sonically heat bonded to itself as a single layer maintaining a low profile (i.e. retaining a thickness approximate to the surrounding region of the hook layer) and without any significant weight addition.

The crushed area formed within the entryway location of the hook surface enables a user to insert one or more digits (fingers or thumb) between the opposing hook and loop configured surfaces of the opposing closure elements to facilitate easier opening and without damaging the closure elements. A corresponding method is also disclosed for sonically heat bonding the reverse folded tab applied against the hook surface utilizing the above structure.

BRIEF DESCRIPTION OF THE DRAWINGS

Reference will now be made to the attached drawings, when read in combination with the following detailed descriptions wherein like reference numerals refer to like parts throughout the several views, and in which.

DETAILED DESCRIPTION OF THE PREFERRED EMBODIMENTS

Figure 1:
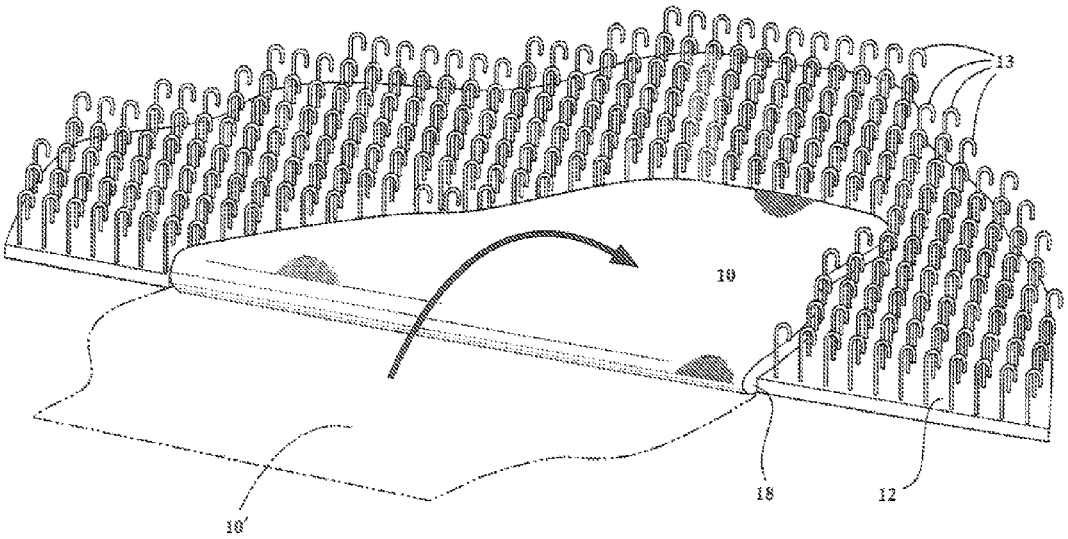
FIG. 1 is an environmental perspective of a hook closure element exhibiting the fold-over tab which is sonically heat bonded to create a consistent thickness gripping area relative to the surrounding area of the hook element.
Figure 2:
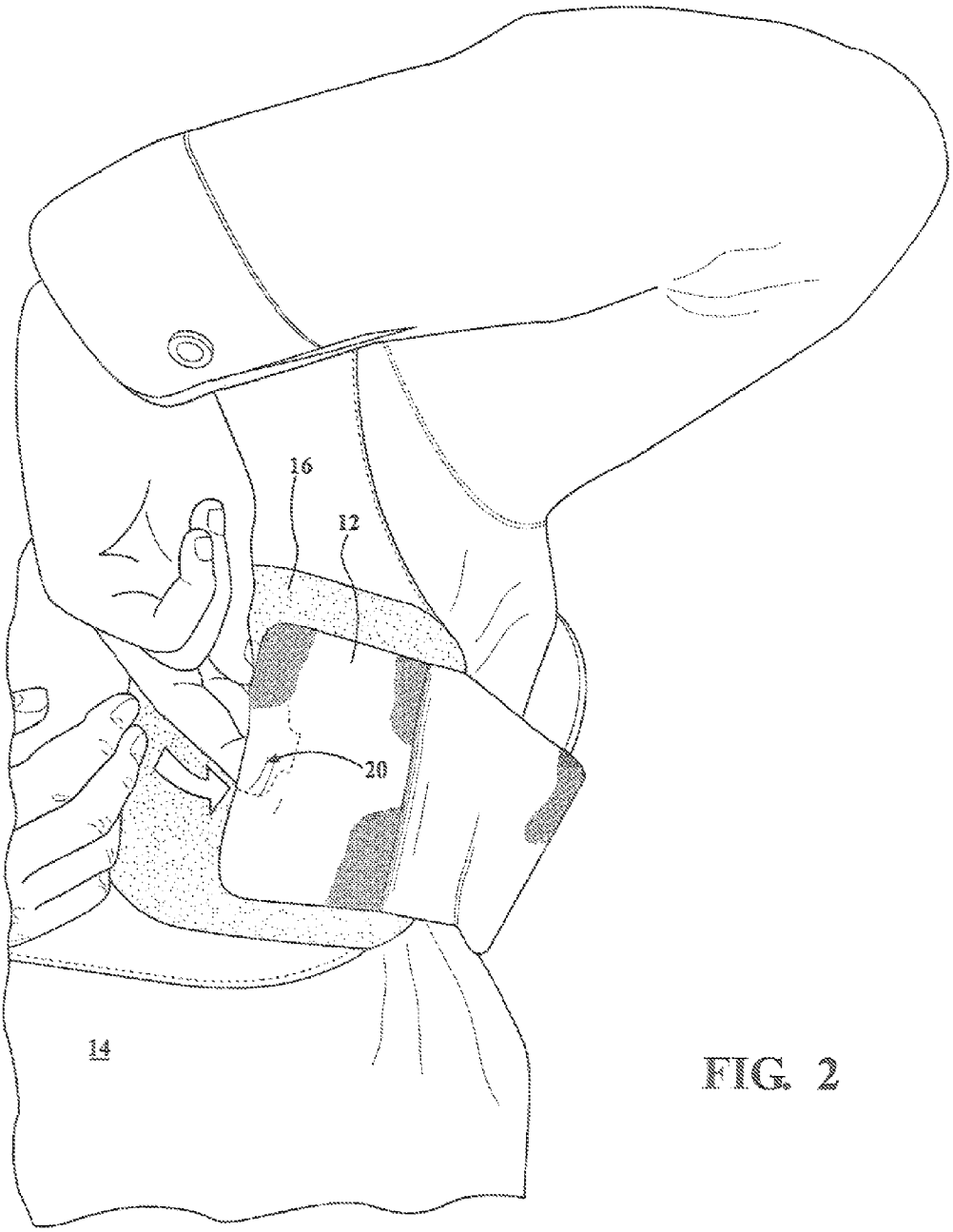
FIG. 2 is an operational perspective depicting a wearer of the garment inserting a pair of digits into the edge proximate access area provided by the tab and in order to provide consistent and controlled "tear-away" separation between the hook and loop closure elements.
Figure 3:
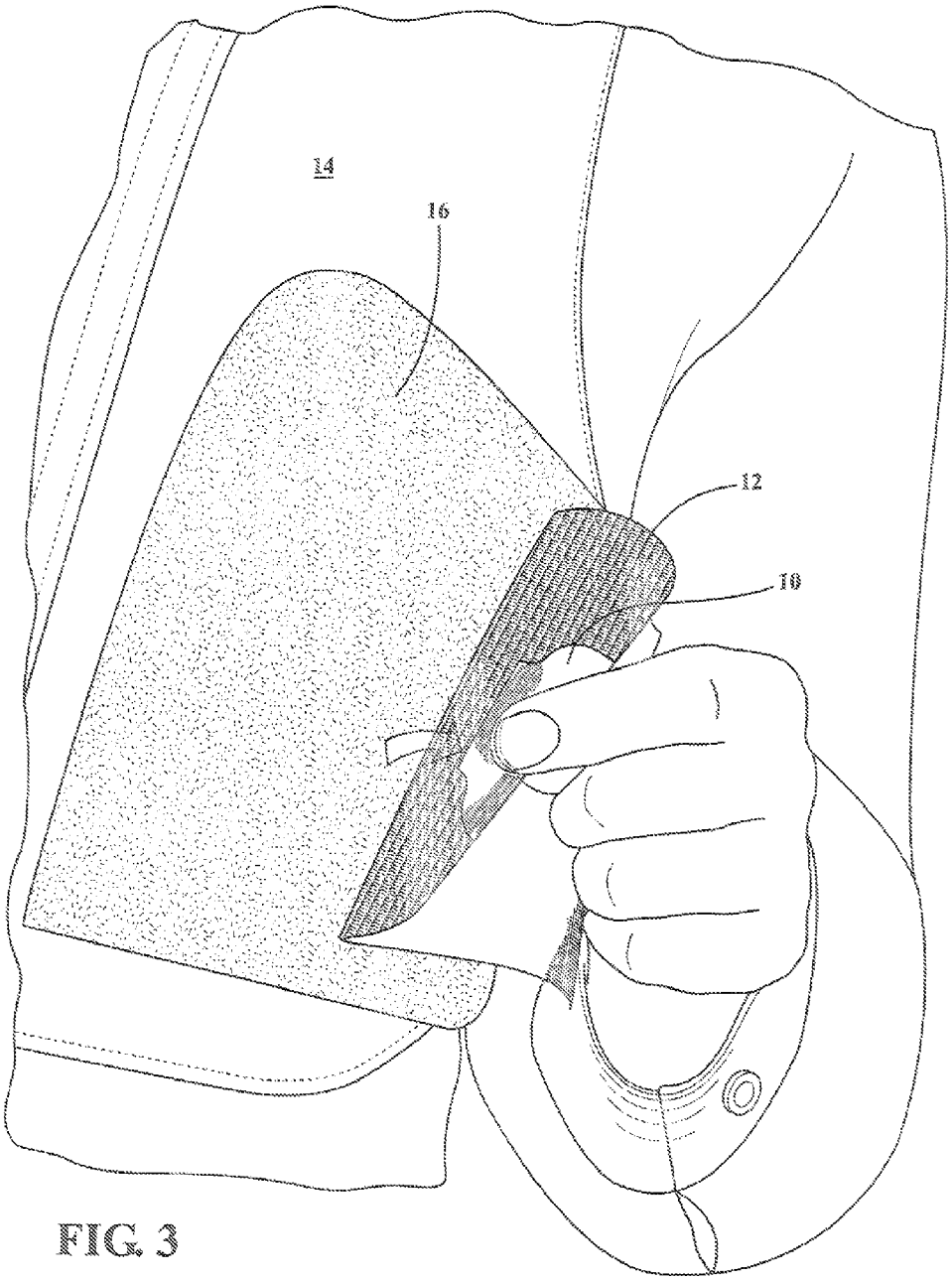
FIG. 3 is a succeeding illustration to that depicted in FIG. 2 and showing the hook closure element in substantially torn away fashion relative to the underlying loop configured surface built into the surface of the vest garment.

With reference to the illustrations set forth as FIGS. 1-3, the present invention discloses ah easy access tab integrated into a hook closure forming a portion of overlapping hook and loop engaging surfaces such as are associated with an adjustable vest-like garment or the like. FIG. 1 is an environmental perspective of a hook closure element exhibiting the fold-over tab 10 which is sonically heat bonded to create a consistent thickness gripping area relative to the surrounding area of a first closure 12 which depicts a large plurality of hook portions 13 on an inner facing surface.

As further depicted in FIGS. 2-3, the hook closure 12 defines an elongated panel (also termed a side strap) which extends from a separated side edge of a vest-like garment 14 (such as a ballistic style vest). The hook closure-panel overlaps and engages, in an adjustable fashion, an underlying loop surfaced panel 16, such as which can be incorporated into a fixed surface location of the garment 14.

The tab as depicted at 10' in FIG. 1 initially exhibits an initial edge extending portion 18 which is folded over and against a forward and central most subset area of the hook surface of the closure 12, following which the smooth reverse surface of the tab 10 is sonically heat bonded which effectively melts the tab info the overlapped area of the hook closure to define a single integrated layer maintaining a low profile (i.e. retaining a thickness approximate to the surrounding region of the hook layer) and without any significant weight addition.

The crushed area formed within the entryway location of the hook surface enables a user to insert one or more digits (fingers or thumb) between the opposing hook and loop configured surfaces of the opposing closure elements to facilitate easier opening and without damaging the closure elements. A corresponding method is also disclosed for sonically heat bonding the reverse folded tab applied against the hook surface utilizing the above structure.

In this manner, the smoothened access area depicted at 20 in FIG. 2 is created by the tab 10 being folded over and sonically bonded against the underlying central location of fee hook closure 12 and defines an integrated single layer which exhibits a thickness consistent with the surrounding areas of the hook closure 12 and without any significant additional weight.

It has also been found that the ability to avoid employing either a heat press for gluing the area 20, or a sewing machine in order to stitch an extra panel over a corresponding hook exhibiting surface of the closure 12, further results in preserving the integrity, shape and durability of the hooks 13 surrounding the smoothened (sonic heat bonded) area achieved through the article and process of the present invention. Further, and because fee sonic bonded portion is fairly straightforward in construction, it enables easier modification in the creation of an overall tab shaping without fundamentally affecting operation (this including both holding and tear away forces).

A corresponding method of creating a smoothed gripping section associated with an entryway between first and second overlapping closures is also disclosed and includes the steps of providing an edge extending tab wife a first strap extending closure exhibiting a hook surface configuration, reverse folding the tab over and against a forward and central most subset area of the hook surface of the closure, following which the tab is sonically heal bonded against the hook closure so that a smooth reverse surface of the tab is exposed and defines a single integrated layer maintaining a low profile (i.e. retaining a thickness approximate to the surrounding region of the hook layer) and without any significant weight addition.

Having described my invention, other and additional preferred embodiments will become apparent to those skilled in the art to which it pertains, and without deviating from the scope of the appended claims. This can include incorporating other methods for creating the smoothened and digit accessible surface location associated with the hook closure, such as including but not limited to any of incising, shearing or other abrading the subset area 20 depicted in FIG. 3 in order to remove a desired plurality of hooks 13, this in order to create the desired access profile for inserting the wearer's digits and again without the undesirable traits of creating a buildup of material at the separation interface or the attachment of separate panel or other material.

I claim:

1. A releasable fastener assembly, comprising:

a front ballistic vest panel of a ballistic garment carrying a first engagement material; and an elongated side strap associated with the ballistic garment carrying a second engagement material, wherein:

the first and second engagement materials are releasably securable to one another;

the elongated side strap comprises a length and a width dimensions wherein the length dimension is greater than the width dimension and the elongated strap carries an area of the second engagement material extending in a direction along the length dimension and in a direction along the width dimension of the elongated side strap; and the elongated side strap comprises an area absent of accessible second engagement material positioned on a side of the elongated side strap carrying the area of the second engagement material, wherein:

the area absent of accessible second engagement material extends along a portion of a distal end of the elongated strap in the direction of the width dimension of the elongated side strap and extends along in the direction of the length dimension away from the distal end positioned between a portion and another portion of the area of the second engagement material.

2. The releasable fastener assembly of claim 1 wherein the first engagement material comprises a plurality of loops and the second engagement material comprises a plurality of hooks.

3. The releasable fastener assembly of claim 1 wherein the elongated side strap extends from a back panel of the ballistic vest garment such that with the first and second engagement material releasably secured to one another, the area absent of accessible second engagement material overlies the first engagement material of the front ballistic vest panel of the ballistic garment.

4. The releasable fastener assembly of claim 1 wherein the area absent of accessible second engagement material comprises a layer of material which overlies a section of the area of the second engagement material.

5. The releasable fastener assembly of claim 4 wherein the layer of material is secured to the elongated side strap.

6. The releasable fastener assembly of claim 4 wherein the second engagement material positioned under the overlying layer of material extends to a reduced elevation above the elongated side strap than the elevation of the second engagement material positioned adjacent to the overlying layer of material.

7. The releasable fastener assembly of claim 1 wherein the first engagement material extends in a direction of a width of the elongated strap positioned to overlie the front ballistic vest panel, such that a dimension to which the first engagement material extends in the direction is greater than a dimension of the width of the elongated strap.

8. The releasable fastener assembly of claim 1, wherein the second engagement material is positioned on and along a periphery of the area absent accessible second engagement material and extends spaced apart from and along the distal end of the elongated strap.

* * * * *

UNITED STATES PATENT AND TRADEMARK OFFICE

CERTIFICATE OF CORRECTION

PATENT NO. : 9,241,547 B2
APPLICATION NO. : 13/644397
DATED : January 26, 2016
INVENTOR(S) : Charles C. Raymond It is certified that error appears in the above-identified patent and that said Letters Patent is hereby corrected as shown below:

On the Title Page:

At item (57), line 13, "reverse," should be -- reverse --.

Signed and Sealed this
Twelfth Day of July, 2016

Michelle K. Lee

Michelle K. Lee
*Director of the United States Patent and Trademark Office*